US007351076B2

(12) United States Patent
Chapman et al.

(10) Patent No.: US 7,351,076 B2
(45) Date of Patent: Apr. 1, 2008

(54) COVER FOR PCI EXPRESS CONNECTOR

(75) Inventors: Cory Allen Chapman, Raleigh, NC (US); Kenneth Scott Seethaler, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 10/863,136

(22) Filed: Jun. 8, 2004

(65) Prior Publication Data

US 2005/0272288 A1 Dec. 8, 2005

(51) Int. Cl.
*H01R 13/44* (2006.01)

(52) U.S. Cl. ..... 439/135

(58) Field of Classification Search ..... 439/135, 439/136, 147–149, 133–134, 217–218; 70/53, 70/57, 63; 220/242; 710/301, 107, 108
See application file for complete search history.

(56) References Cited

U.S. PATENT DOCUMENTS

| | | | | |
|---|---|---|---|---|
| 5,199,888 | A * | 4/1993 | Condra et al. | 439/142 |
| 5,756,937 | A * | 5/1998 | Gleadall | 439/135 |
| 5,961,352 | A | 10/1999 | Denny et al. | 439/637 |
| 6,154,728 | A | 11/2000 | Sattar et al. | 705/28 |
| 6,269,416 | B1 | 7/2001 | Meier et al. | 710/102 |
| 6,408,352 | B1 | 6/2002 | Hosaka et al. | 710/129 |
| 6,463,493 | B1 | 10/2002 | Hayes et al. | 710/301 |
| 6,477,603 | B1 | 11/2002 | Locker et al. | 710/301 |
| 6,662,540 | B1 | 12/2003 | Harkcom et al. | 56/228 |
| 6,701,400 | B2 | 3/2004 | Hayes et al. | 710/301 |
| 6,784,870 | B2 * | 8/2004 | Yin | 345/156 |
| 2003/0033170 | A1 | 2/2003 | Bhatt et al. | 705/4 |
| 2003/0037288 | A1 | 2/2003 | Harper et al. | 714/37 |
| 2003/0061104 | A1 | 3/2003 | Thomson et al. | 705/26 |
| 2003/0063779 | A1 | 4/2003 | Wrigley | 382/116 |
| 2003/0091352 | A1 | 5/2003 | Carling et al. | 399/24 |
| 2003/0115158 | A1 | 6/2003 | Richardson | 705/400 |
| 2003/0135431 | A1 | 7/2003 | Schwartz et al. | 705/28 |
| 2003/0139982 | A1 | 7/2003 | Schwartz et al. | 705/28 |
| 2003/0154094 | A1 | 8/2003 | Bredemeier et al. | 705/1 |
| 2003/0167210 | A1 | 9/2003 | Miller et al. | 705/26 |
| 2003/0217043 | A1 | 11/2003 | Weiss et al. | 707/2 |
| 2004/0102068 | A1 * | 5/2004 | Lai et al. | 439/135 |

OTHER PUBLICATIONS

Vladicescu, Fl. Popentiu; Albeanu, G.; Sens, Pierre; Thyregod, Poul; *Software Architecture for Distributed Systems (SADS): NN and EV Approaches*, 2001.
*Idea Paper: A Failure Analysis Matrix*, 2002.

* cited by examiner

*Primary Examiner*—Felix Figueroa
(74) *Attorney, Agent, or Firm*—John L. Rogitz

(57) ABSTRACT

A parallelepiped-shaped plastic cover for a PCI express ×16 connector array has a top defining a window. Some but not all of the connector array elements are blocked by the top when the cover is positioned over the connector array, so that in the event that the associated computer is not configured for receiving components requiring connections to all elements of the PCI express ×16 connector array, a user cannot unwittingly plug such a component into the PCI express connector array but can only plug in, through the window, components requiring fewer than all connector elements.

6 Claims, 3 Drawing Sheets

*Figure 3*
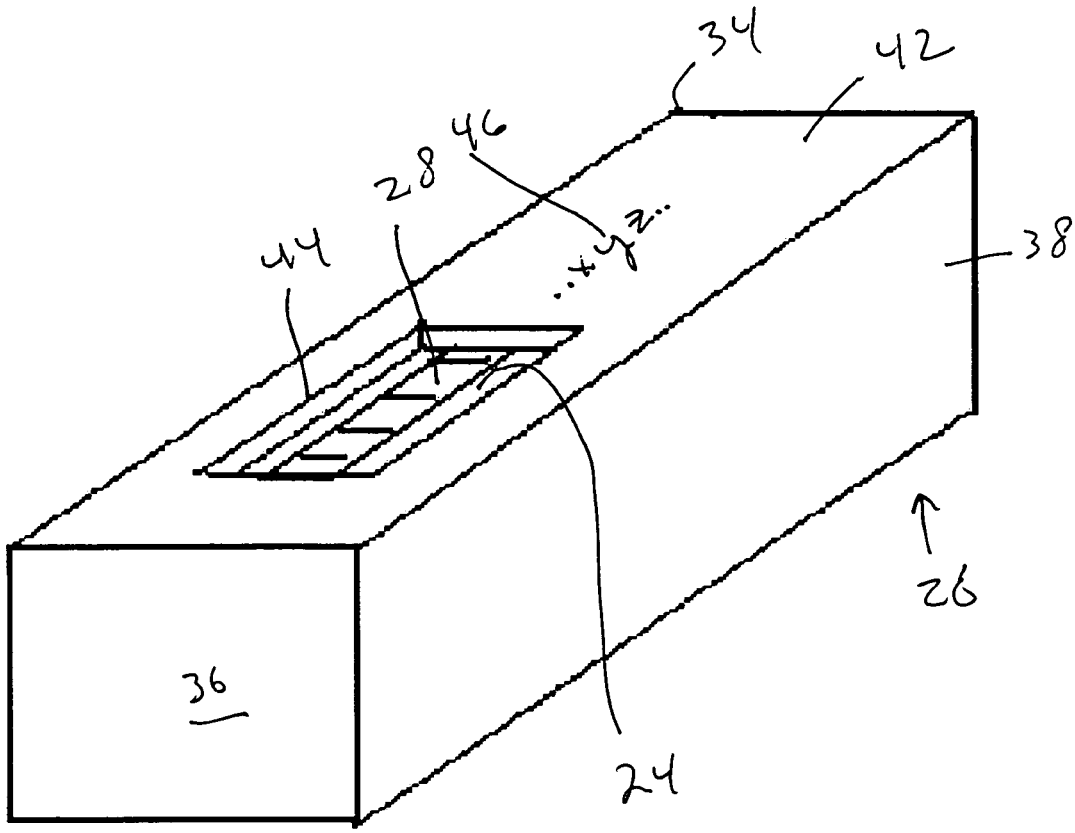
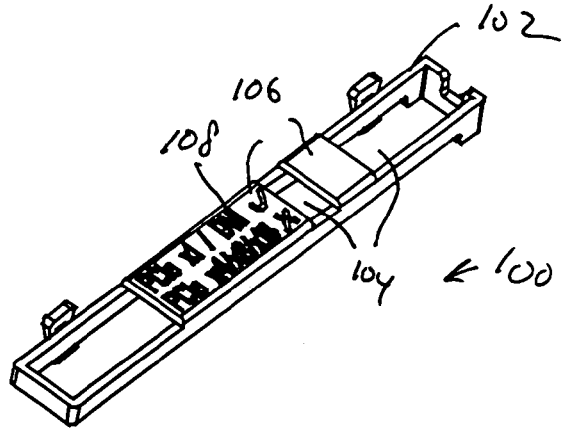
Fig. 4

COVER FOR PCI EXPRESS CONNECTOR

I. FIELD OF THE INVENTION

The present invention relates generally to PCI Express connectors.

II. BACKGROUND OF THE INVENTION

Personal computers can be connected to various peripheral components using peripheral component interconnect (PCI) connectors. Since its inception in 1992, the PCI bus has become the input/output standard of most computing platforms. Computer central processing units can be connected, using PCI architecture, to hard disk drives, printers, networks, and various other components. This relatively old connector/interface technology, however, has resulted in bottlenecks as newer, higher speed, more powerful computer components have been introduced.

Not surprisingly, the PCI technology has evolved by offloading various functions to higher-bandwidth PCI derivatives, including AGP and PCI-X, both of which are PCI variants. Unfortunately, the PCI bus cannot be easily scaled up in frequency or down in voltage. In addition, the PCI bus does not support features such as advanced power management, native hot plugging/hot swapping of peripherals, or quality of service to guarantee bandwidth for real-time operations. Finally, all of the available bandwidth of the PCI bus is limited to one direction of communication (send or receive) at a time. This is a drawback because many communication networks support simultaneous bidirectional traffic, which minimizes message latency.

A relatively new connector architecture known as PCI express (formerly "3GIO") has been introduced which uses four wires of two differential pairs to support simultaneous two-way communication. More particularly, PCI express uses a high speed serial link (unlike 32 bit and 64 bit parallel buses) that consists of dual simplex channels, each implemented as a transmit pair and a receive pair for simultaneous transmission in each direction. Each pair consists of two low-voltage, differentially driven pairs of signals. A PCI Express link can be scaled by adding signal pairs to form multiple lanes between two devices, with one bit (×1), four bit (×4), eight bit (×8), and sixteen bit (×16) lane widths being supported.

With that overview of PCI express in mind, the present invention recognizes that the PCI express architecture can support components having connectors (i.e., ×1, ×4, ×8, and ×16) of various sizes, ranging from smallest (×1), requiring the fewest connector elements, to the largest (×16) such as some video cards, which requires all 164 connector elements of a PCI express connector. In other words, a single PCI express connector on the motherboard of a computer is expected to support component connectors of various sizes. However, as understood herein some computers and/or their operating systems might not be configured to operate with components having larger (e.g., ×16) connectors. Nevertheless, the presence of the single PCI express connector might induce a user to unwittingly plug into the connector an unsupported component, on the erroneous assumption that the component is supported by the computer. This invention is directed to that problem.

SUMMARY OF THE INVENTION

A computer connector system includes a peripheral component interconnect (PCI) express connector assembly that has first connector elements and second connector elements at least some of which can be electrically connected to a computer component such as a CPU. A hollow cover is configured for closely receiving the PCI express connector in an interference fit. In accordance with the present invention, the cover defines a top that is solid except for a window which permits access to the first connector elements but not the second when the cover is engaged with the connector.

In non-limiting embodiments the cover has two short sides parallel to each other and two long sides parallel to each other, with each side being orthogonal to its adjoining sides. The cover may also have a substantially completely open bottom opposite the top to receive the connector through the open bottom. The cover may be made of a single unitary piece of plastic.

If desired, the top can bear indicia representing instructions for use. Specifically, the instructions for use can relate to removing the cover. The first and second connector elements together can define a ×16 PCI express connector array.

In another aspect, a device is disclosed for rendering a connector array configured to accept relatively large connectors to physically accept only connectors that are smaller than the relatively large connectors. The device includes a hollow unitary plastic body defining a parallelepiped-shaped enclosure configured to closely receive the connector array. The body defines a partially open top which permits access to some but not all connector elements of the connector array when the body is engaged with the connector array.

In still another aspect, a method for impeding misplugs of computer component connectors into a PCI express ×16 connector array includes providing a cover having an open bottom and a top opposed thereto, and positioning the cover on the PCI ×16 express connector array in close engagement therewith with the top covering some, but not all, connector elements of the PCI express ×16 connector array.

The details of the present invention, both as to its structure and operation, can best be understood in reference to the accompanying drawings, in which like reference numerals refer to like parts, and in which:

BRIEF DESCRIPTION OF THE DRAWINGS

FIG. 3 is a perspective view of the present cover engaged with a PCI express connector; and FIG. 4 is a perspective view of an alternate cover.

DETAILED DESCRIPTION OF THE PREFERRED EMBODIMENT

As used herein, the term "PCI express connector" generally refers to a connector that uses differential pairs of simplex channels in a serial link to support simultaneous two-way communication through the connector, and that can support component connectors of at least two different sizes, unless otherwise more explicitly limited in the claims.

Figure 1:
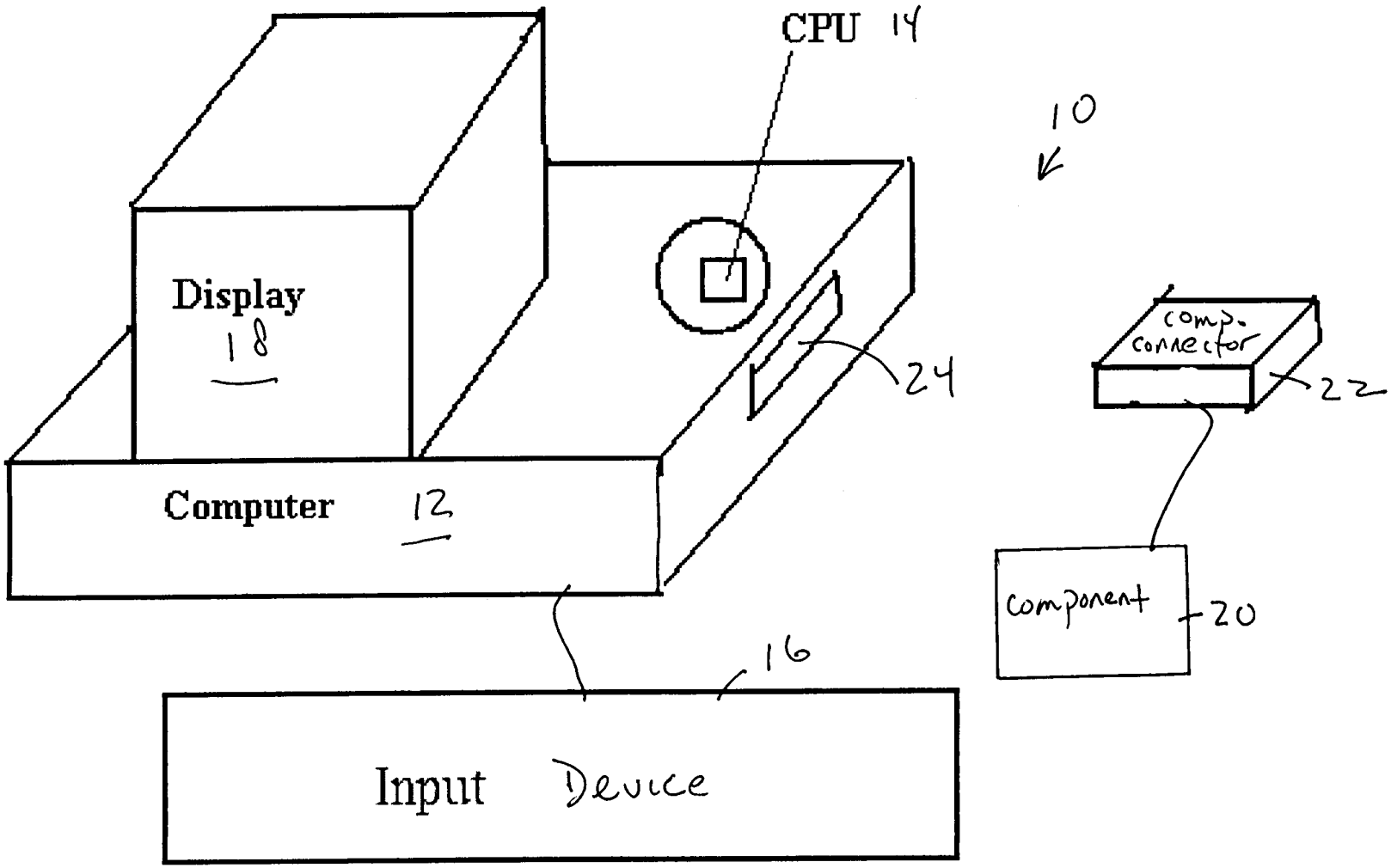
FIG. 1 is a block diagram showing a computer with PCI express connector, with portions of the computer cut away to schematically show the CPU.

Referring initially to FIG. 1, a system is shown, generally designated 10, that includes a computer 12 such as but not limited to a personal computer (PC) having a central processing unit (CPU) 14. Input to the computer 12 can be provided by an input device 16, such as, without limitation, a mouse, keyboard, voice recognition device, or other input device, while output can be presented on, e.g., a display 18 or other output device such as but not limited to a printer, computer network, etc.

One or more components 20 (only a single component shown in FIG. 1 for clarity) that are associated with respective component connectors 22 can be engaged with the CPU 14 by plugging the component connector 22 into a CPU connector 24. In accordance with the present invention, the CPU connector 24 may be a PCI express connector, and specifically one that can support connectors as large as ×16 components, i.e., one that may include 164 connector elements. The connector elements of the CPU connector 24 which face the component connector 22 typically are female (e.g., sockets), with male pins extending from the CPU connector 24 into the computer 12 for connection to the CPU 14. It is to be understood that the male/female configuration can be reversed. On the other hand, the component connector 22 is smaller than the largest connector that is supported by the CPU connector 24. In non-limiting embodiments the component connector 22 may be a PCI express ×1, ×4, or ×8 connector.

Figure 2:
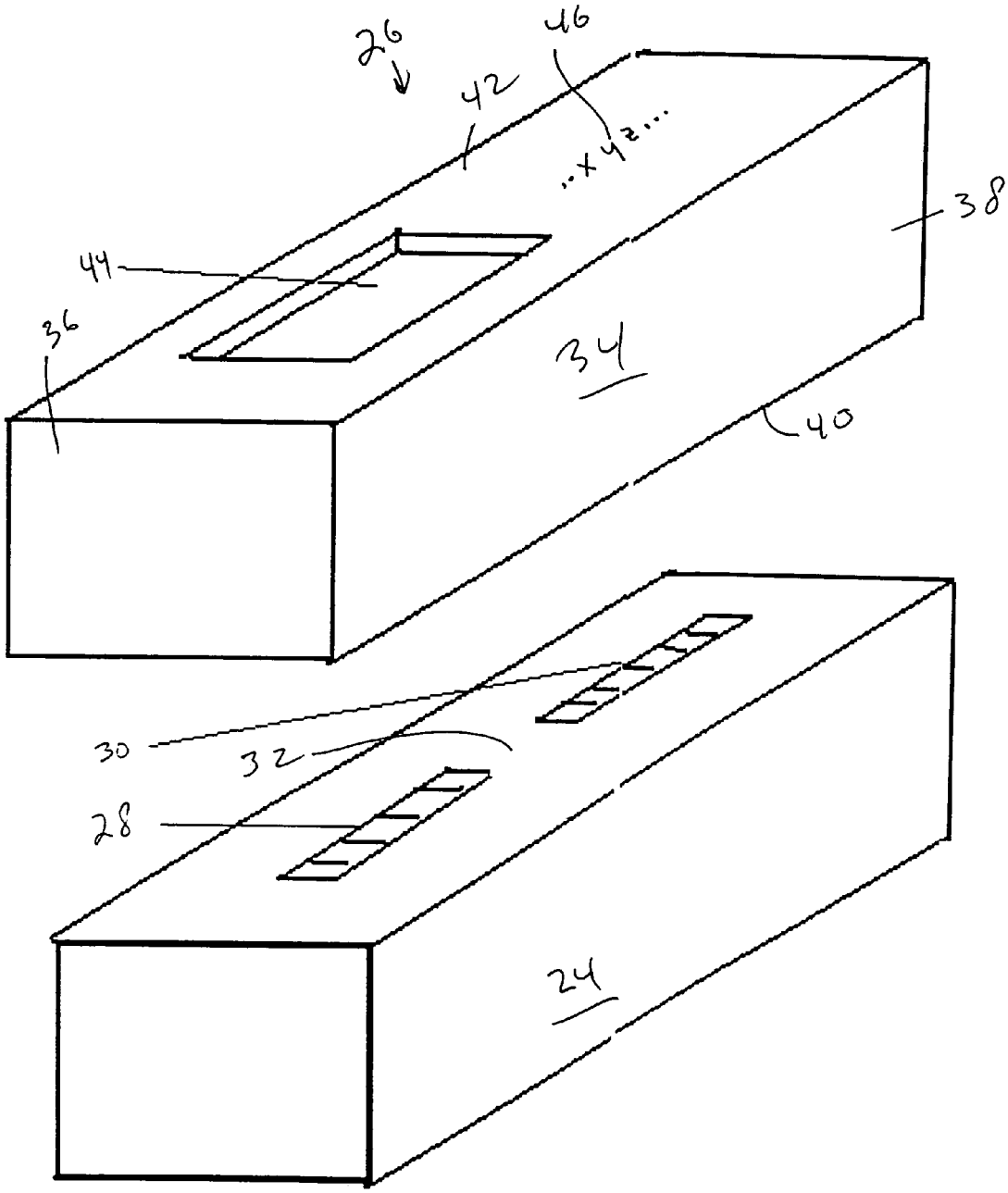
FIG. 2 is a perspective view of the present cover in an exploded relationship with a PCI express connector.

Now referring to FIGS. 2 and 3, assuming that the computer 12 happens to be unable to support components requiring component connectors of the largest PCI express size (or sizes), to prevent a component connector having a size of, e.g., an ×16 connector from being engaged with the CPU connector 24, a cover, generally designated 26, is engaged with the CPU connector 24. As shown best in FIG. 2, the CPU connector 24 has at least first and second connector elements 28, 30 that may be separated by a key 32 and that together define a ×16 PCI express connector array, with the first connector elements 28 being configured to support smaller connectors such as, e.g., ×1, ×4, and ×8 connectors. It will be appreciated that at least some of the connector elements and in particular at least the first connector elements 28 are electrically connected to the CPU 14. The cover 26, which includes an elongated, hollow, parallelepiped-shaped body 34 preferably made of a single unitary piece of plastic by, e.g., injection molding, closely receives the CPU connector 24 preferably in an interference fit.

The non-limiting body 34 of the cover 26 has two short sides 36 that are parallel to each other and two long sides 38 that are parallel to each other, with each side 36, 38 being orthogonal to its adjoining sides to establish a parallelepiped-shaped structure (and, hence, an interior parallelepiped-shaped enclosure to receive the CPU connector 24). Also, the body 34 has a completely open bottom 40 through which the connector is received:

In accordance with the present invention, opposite the bottom 40, the body 34 of the cover 26 has a rectangular planar top 42, and the top 42 is solid except for a window 44 which is formed therein to permit access to the first connector elements 28 (and if desired, to the key 32) as shown in FIG. 3 when the cover 26 is engaged with the CPU connector 24. However, the top 42 blocks access to the second connector elements 30 when the cover 26 is engaged with the CPU connector 24. If desired, the top 42 can bear indicia 46 that can, e.g., instruct a user to remove the cover 26 from the CPU connector 24 if it is desired to engage a ×16 component connector with the CPU connector 24.

It is to be understood that while a single solid segment and single window is shown, the top 42 can have more than one window and more than one solid segment with windows and solid segments alternating with each other, as long as the size of connector sought to be blocked from engagement is indeed blocked. For instance, the cover 100 shown in FIG. 4 has a top 102 that has plural windows 104 alternating with plural solid segments 106, one of which bears operating instruction indicia 108.

It may now be appreciated that the cover 26 renders the CPU connector 24, which is otherwise configured to accept relatively large (e.g., ×16 connectors), to physically accept only connectors that are relatively smaller, e.g., ×1, ×4, ×8 connectors, because the top 42 of the cover 26 permits access to some but not all connector elements of the connector array. In this way, the cover 26 impedes misplugs of computer component connectors into the CPU connector 24 in the event that the computer 12 does not support the associated computer components.

While the particular COVER FOR PCI EXPRESS CONNECTOR as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". It is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for" or, in the case of a method claim, the element is recited as a "step" instead of an "act". Absent express definitions herein, claim terms are to be given all ordinary and accustomed meanings that are not irreconcilable with the present specification and file history.

What is claimed is:

1. A computer connector system, comprising:

at least one peripheral component interconnect (PCI) express connector assembly having first connector elements and second connector elements together defining a ×16 PCI express connector array, with the first connector elements being configured to support connectors smaller than ×16 PCI express connectors, at least some elements being electrically connected to at least a first computer component; and a hollow cover configured for closely receiving the PCI express connector assembly in an interference fit, the cover defining a top, the top being solid except for at least one window formed therein to permit access to the first connector elements when the cover is engaged with the connector but to not permit access to the second connector elements when the cover is engaged with the connector.

2. The system of claim 1, wherein the cover has two short sides parallel to each other and two long sides parallel to each other, each side being orthogonal to its adjoining sides, the cover having a substantially completely open bottom opposite the top to receive the connector through the open bottom.

3. The system of claim 2, wherein the cover is plastic.

4. The system of claim 3, wherein the cover is made of a single unitary piece of plastic.

5. The system of claim 1, wherein the top bears indicia representing instructions for use.

6. The system of claim 5, wherein the instructions for use relate to removing the cover.

* * * * *